US005736698A

United States Patent [19]

Mattlar et al.

[11] Patent Number: 5,736,698

[45] Date of Patent: Apr. 7, 1998

[54] SWITCH FOR CONTROLLING ELECTRICAL EQUIPMENT

[75] Inventors: Harri Mattlar, Vasa; Matti Pussinen, Laihia, both of Finland

[73] Assignee: ABB Control Oy, Vaasa, Finland

[21] Appl. No.: 596,169

[22] PCT Filed: Jul. 20, 1994

[86] PCT No.: PCT/FI94/00328

§ 371 Date: Feb. 13, 1996

§ 102(e) Date: Feb. 13, 1996

[87] PCT Pub. No.: WO95/05673

PCT Pub. Date: Feb. 23, 1995

[30] Foreign Application Priority Data

Aug. 13, 1993 [FI] Finland ..... 933597

[51] Int. Cl.[6] ..... H01H 21/84

[52] U.S. Cl. ..... 200/16 R; 200/4

[58] Field of Search ..... 200/1 R, 4, 5 R, 200/5 A, 6 R, 11 R, 6 B–6 C, 16 A, 16 C, 17 R, 18, 564, 568, 336, 337, 11 A–11 K, 16 R–16 D, 569–572

[56] References Cited

U.S. PATENT DOCUMENTS

| | | | |
|---|---|---|---|
| 3,525,828 | 8/1970 | Echart et al. | 200/16 |
| 4,012,606 | 3/1977 | Hutt | 200/18 |
| 4,713,498 | 12/1987 | Ludwig et al. | 200/5 R |
| 4,816,625 | 3/1989 | Chen | 200/16 D |
| 5,389,754 | 2/1995 | Muller et al. | 200/292 |
| 5,491,311 | 2/1996 | Muscat et al. | 200/4 |

*Primary Examiner*—Cassandra C. Spyrou
*Assistant Examiner*—Michael A. Friedhofer

[57] ABSTRACT

A manually operated switch device for the control of electrical equipment, wherein the electrical elements of the switch are assembled in a housing and the mechanical elements are mounted on a body piece attached to the housing. At least one linearly transferrable slide member communicates with the body piece, the slide member having contact or guide surfaces adapted to cooperate with the stationary contacts. To the slide member is connected via at least one spring-type element, a power-spring-arming plate which is movable in parallel relationship with the slide member, in such a manner that during the movement of the power-spring-arming plate, the slide member is correspondingly moved under the force exerted by the power springs. By virtue of this arrangement, the switching phase always occurs in a consistent manner, irrespective of the speed used for rotating the switch operating lever.

5 Claims, 9 Drawing Sheets

SWITCH FOR CONTROLLING ELECTRICAL EQUIPMENT

BACKGROUND AND SUMMARY OF THE INVENTION

The present invention is related to a manually operated switch for the control of electrical equipment.

For switches employed in electrical equipment, the switch position or the switch status must be secured so that an uncontrolled change of the switch state cannot readily occur. An inadvertent starting of an electrical apparatus due to, e.g., vibration or a strong shock, causing the movement of the switch to a wrong position, may produce a very dangerous and hazardous situation as a result of the unintentional starting of the equipment. The inadvertent switching-on of electric power in a circuit may also be hazardous during, e.g., maintenance operations. Correspondingly, unintentional toggling of a switch to the zero position, that is, the switching off of the current from an electric circuit may cause machinery damage due to uncontrolled stopping of actuators. Due to such risks, reliable latching of equipment switches in their ON and OFF positions using, e.g., spring-loaded means is very important.

Positive latching of a switch position can be implemented by means of, e.g., a cam attached to the switch operating shaft, whereby the cam is followed by a spring-loaded detent lever. The detent lever is provided with a guide slot suited to accommodate a guide pin fixed to the body structure of the switch. The loading spring of the detent lever is adapted about the detent lever and compressed between the guide pin and the meeting point of the detent lever with the cam. When the switch is in its ON position or in its OFF position, the spring positively latches the switch in its set position and prevents uncontrolled rotational movement of the switch operating shaft. As the shaft is rotated, the spring is compressed between the guide pin and the cam tip. After the cam tip is rotated to its top dead center position, the toggling point of the cam/detent system is attained and as the cam is further rotated over its TDC position, the spring pushes the cam and the attached switch operating shaft to its opposite position.

However, such a switch construction has some drawbacks. Although the spring can positively latch the switch in a correct position, at the ends of the shaft rotational travel, the operation of the switch is rather uncontrolled in the middle of the shaft rotational travel. In the TDC position of the cam/detent mechanism, the spring force is oriented perpendicular to the longitudinal axis of the cam/detent combination, thus being exerted onto the switch operating shaft and not exerting a rotational force on the switch operating shaft and the guide pin. Consequently, this sector of the rotational travel forms an undetermined position of the switch setting, in which the switch may remain after operation by a careless user. The mutual friction between the switch members makes such a position uncontrollable and relatively easily permits the switch to assume this intermediate position. As the intermediate position coincides with the TDC position of the cam/detent mechanism, the position is quite unstable. Therefore, a switch left in this intermediate position may readily toggle from this intermediate position due to, e.g., a small shock to either limit position. Consequentially, such an uncontrolled change of switch position can cause an inadvertent starting of the equipment or the switching-on of the power in an electric circuit which is supposed to be at zero voltage. Obviously, a hazardous situation occurs.

In addition to that discussed above, a conventional switch has the drawback that the operating speed of the switch is dependent on the operator action. This property degrades the electrical performance specifications of the switch. When the switch is operated using, e.g., too low a torque, the switching action does not take place at sufficient speed, whereby an arc will be formed between the contacts that can destroy the switch very quickly as the energy released by the arc obviously has the greater burning effect the longer the arc is maintained. In addition to inadvertent arcing, the switch can be willfully misused by keeping the switch in a position that makes a marginal connection via the burning arc. Obviously, such a misuse destroys the switch very rapidly. According, it is an object of the present invention to provide a switch construction which offers distinct and secure latching in the OFF position and the ON position, respectively, during the operation of the switch.

Another object of the present invention is to provide a switch construction in which the operating member always assumes a position clearly indicating the status of the switch and is capable of actuating the switch contacts at a high speed, independent of the manual actuating speed exerted by the operator.

The present invention is based on a switch mechanism with at least one linearly movable slide member with contacts adapted for compatible interaction with the stationary contacts of the switch. To the slide member is connected via at least one spring-type member and parallel with the slide member, a movable power-spring-arming plate which, during the moving of said plate, causes the slide member to move correspondingly under the force exerted by the springs.

The greatest benefit of the invention is that the switch consistently performs a distinct and unambiguous toggling from one state to another, and the construction of switch device inhibits setting of the switch to any intermediate position. The switch is latched in both the ON position and the OFF position both mechanically and via a spring-exerted force for positively securing the switch in the desired position. Furthermore, the switch includes a mechanical force-disconnect means which performs the forced disconnection of welded contacts in the case such welding might occur. If the adherence of the welded contacts is so strong as not to permit even a forced disconnection thereof, the switch operating means automatically returns to the ON position thus removing any ambiguity of the switch state.

The power-spring-arming plate controls the connect/disconnect function, entirely independent of the operator interaction and consistently at a high speed, because the toggling phase is carried out in a controlled fashion actuated by tensioned springs at a constant speed, independent of the rotational speed at which the operator rotates the switch operating means. Hence, the switch disclosed herein is inherently immune to any kind of misuse.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE INVENTION

Figure 1:
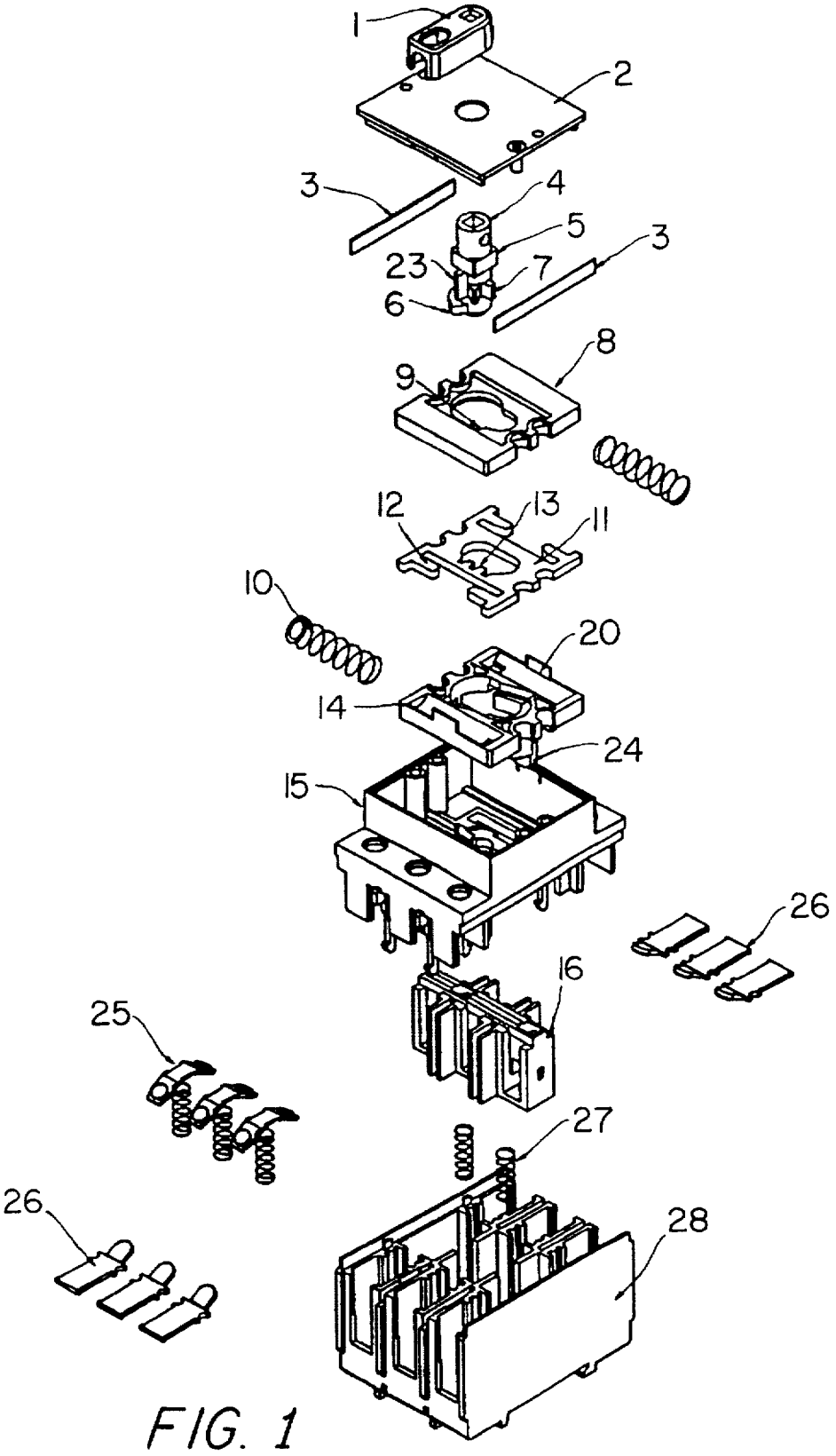
FIG. 1 is an exploded view of a switch according to the present invention.
Figure 3:
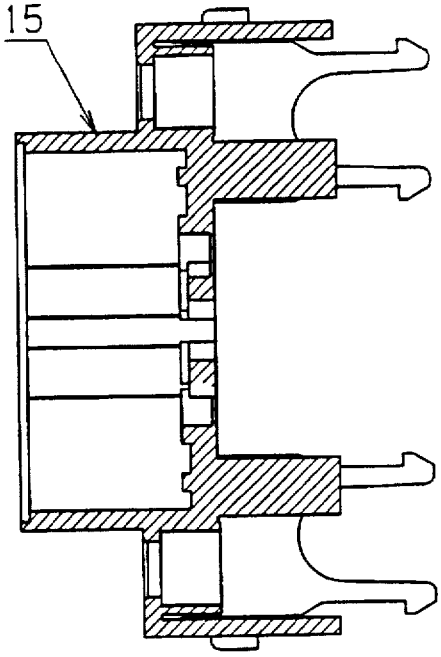
FIG. 3 is the body piece illustrated as FIG. 2 shown in a sectional view taken along line A—A.
Figure 2:
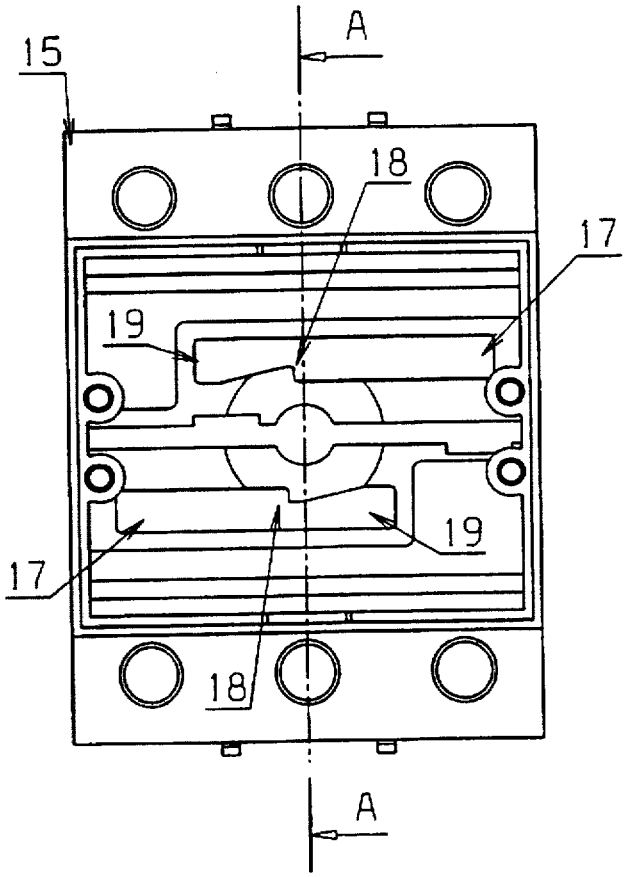
FIG. 2 is a top view of the body piece of the switch illustrated in FIG. 1.
Figure 4:
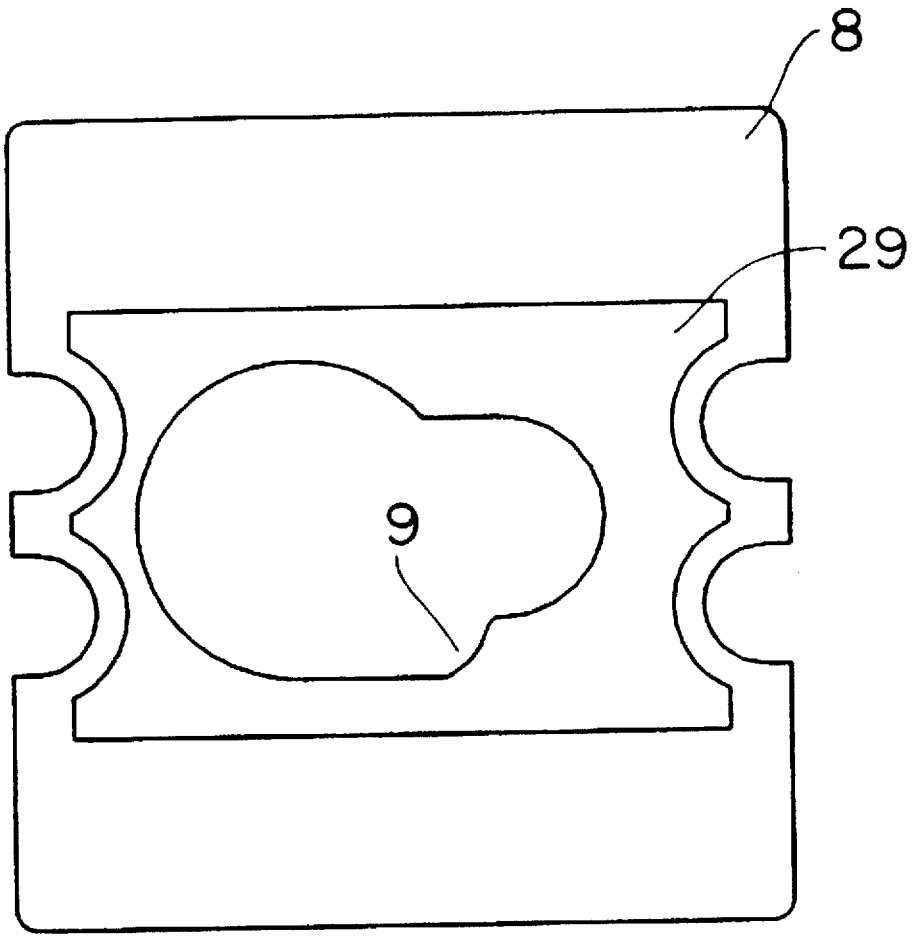
FIG. 4 is a top view of the upper slide member.
Figure 5:
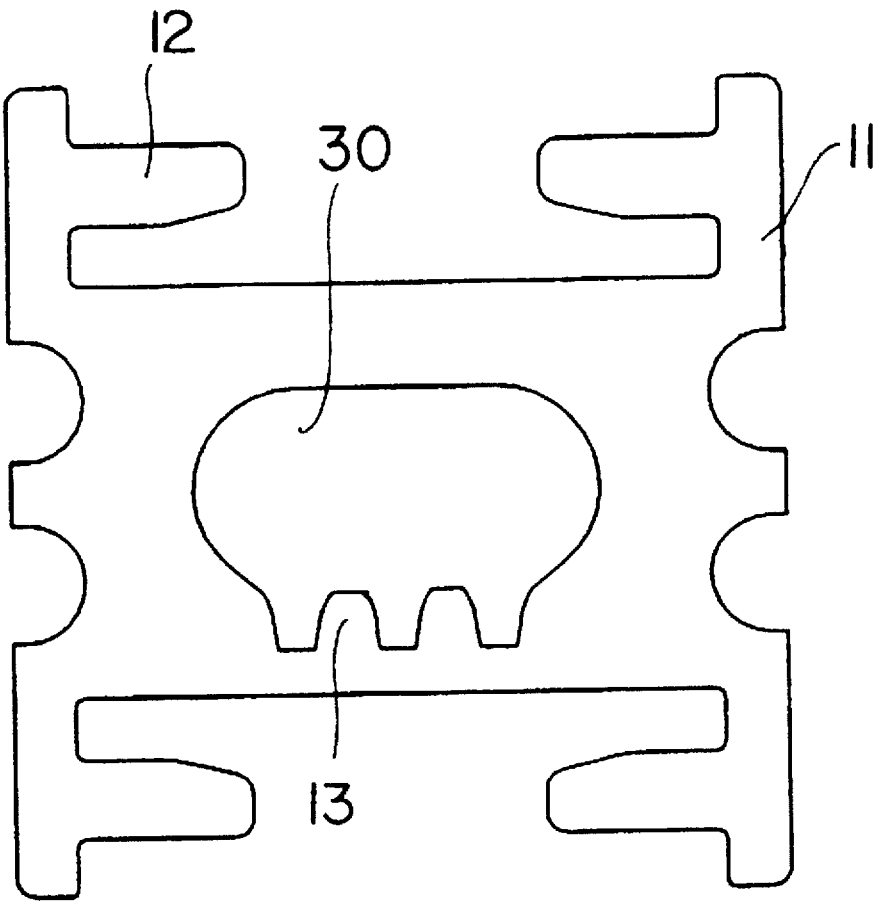
FIG. 5 is a top view of the power spring arming plate.
Figure 6A:
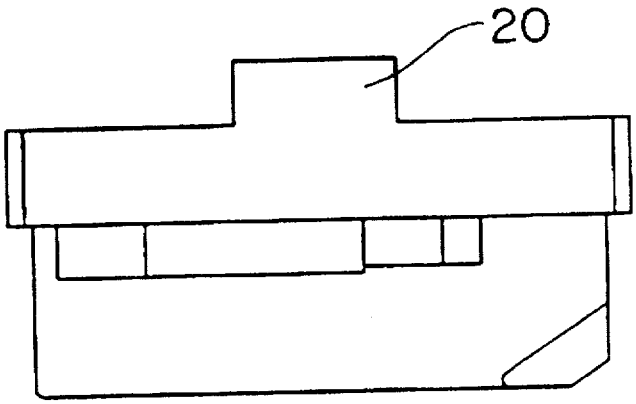
FIG. 6A is a side view of the lower slide member.
Figure 6B:
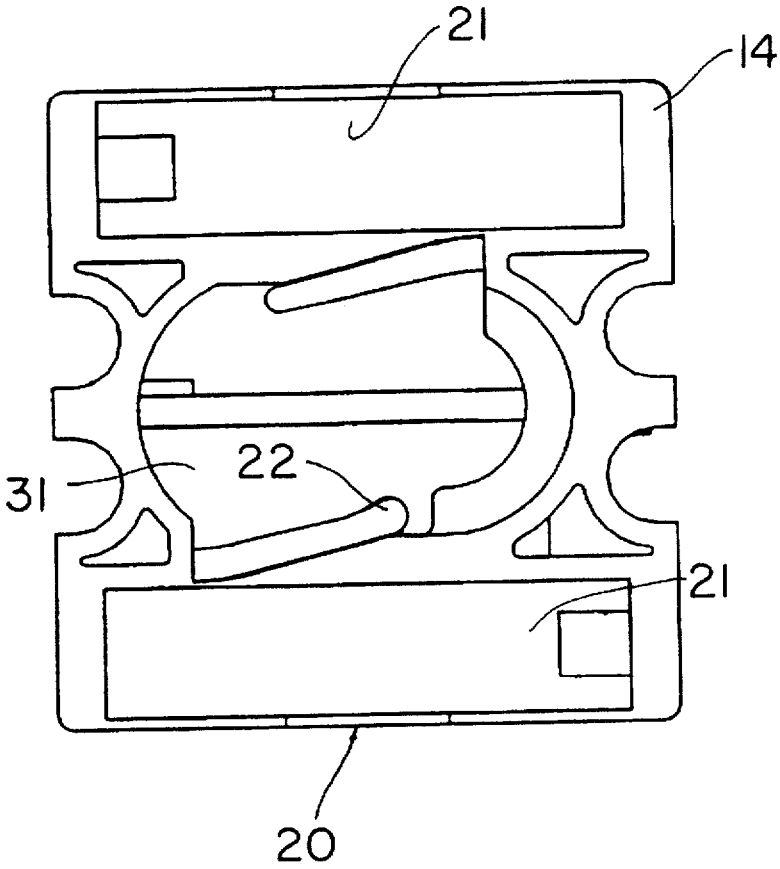
FIG. 6B is a top view of the lower slide member.

The switch according to the present invention is assembled into a body piece 15. The space of the body piece 15 on the assembly cavity side, houses the members of the operating mechanism, while the other side, in the illustrated embodiment, houses a contact bridge 16, which communicates via a slanted surface with a lower slide member 14. The contact bridge 16 is movably attached via springs 27 to a housing 28. The moving contacts of the switch are situated on the contact bridge 16, while the opposite contacts are fixedly mounted relative to the body piece 15. Switching is performed by moving the lower slide member 14, which then moves, via the slanted surface 24, the moving contacts 25 of the contact bridge 16 relative to the stationary contacts 26. Alternatively, the moving contacts may be directly mounted on the lower slide member and the stationary contacts directly in the body piece 15, respectively. As the structure of the contacts is irrelevant to the function of the invention, their detailed description is omitted herefrom. To assemble the elements into the assembly cavity, the lower slide member 14 is inserted first, said member having an aperture 31 in its center and accommodations 21 for receiving springs at both sides of the hole. Power springs 10 are placed into these accommodations 21 and the springs are mounted between retaining pegs 12 situated at both edges of the power-spring-arming plate 11 which is placed over the lower slide member 14. Over the power-spring-arming plate 11 is placed an upper slide member 8, which is connected to the lower slide member 14 by means of two tabs 20, one of which is located in the lower slide member 14 and the other is located in the upper slide member 8. The switch operating shaft 4 passes through apertures 29, 30, and 31 provided in the lower slide member 14, the power-spring-arming plate 11 and the upper slide member 8. To both sides of the switch operating shaft 4 are provided adapted detent leaf springs 3 which rest against detent teeth 5 made on the operating shaft 4. The end of the switch operating shaft 4 has cams 6, and transfer teeth 7, 23 are provided on the shaft perimeter remaining between the cams 6 and the detent teeth 5. The assembly cavity of the body piece 15 is sealed by a cover 2, and the operating lever 1 of the switch shaft is attached to that end of the switch operating shaft 4 passing through the cover 2.

The bottom of the assembly cavity of the body piece 15 is provided with locking slots 17 incorporating locking teeth 18 at that side of the slots which are closer to the body piece center axis. The locking tooth 18 is a projection having a straight side oriented to the center of the body piece and projecting orthogonally from the surface of the locking slot 17, while the other side of the projection is slanted relative to the straight side and oriented in the opposite direction. Said slanted side separates from the end of the locking slot 17 by a locking space 19. The lower slide member 14 is provided with resilient fingers 22 which are inserted in the locking slots 17 when the lower slide member 14 is inserted into the body piece 15. The cams 6 of the switch operating shaft 4 are designed to cooperate with said fingers 22.

The side of the aperture 30 at the center of the power-spring-arming plate 11 is provided with teeth 13 suited to cooperate with the transfer teeth 7 of the switch operating shaft 4. The side of the aperture 30.in the upper slide member 8 is provided with a force-exerting surface 9, which cooperates with the endmost tooth 23 of the transfer teeth 7 at the side of the switch operating shaft 4 when the shaft is inserted in the aperture.

The function of a switch assembled in the above-described manner is discussed as follows. The discussion assumes the switch to be initially in a position in which the operating lever 1 of the switch in the OFF position points to the right, and correspondingly, the operating lever 1 points downward when the switch is in the ON position.

Figure 7:
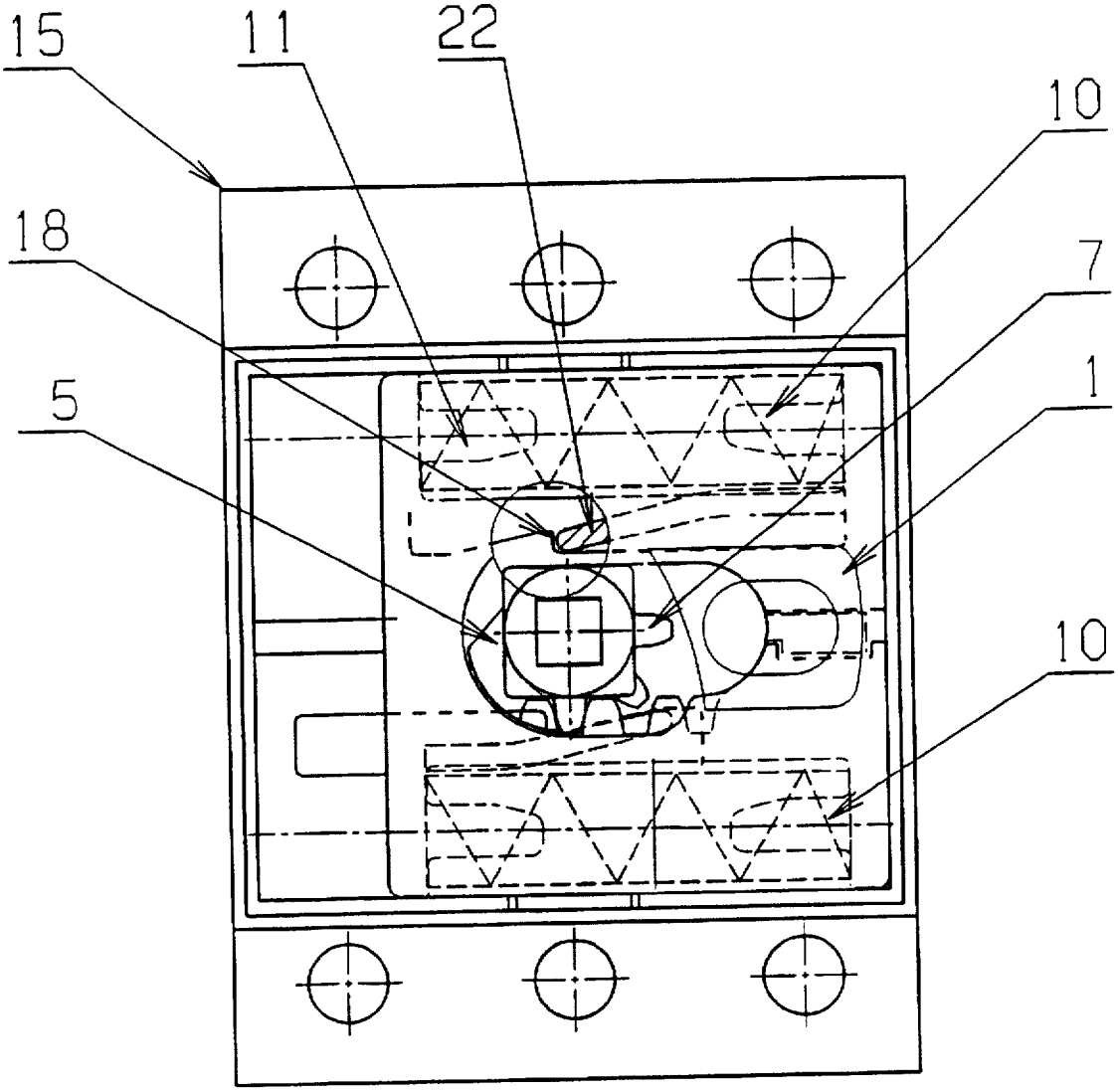
FIGS. 7–10 are diagrammatic illustrations of the switch mechanism in its different operating positions.
Figure 8:
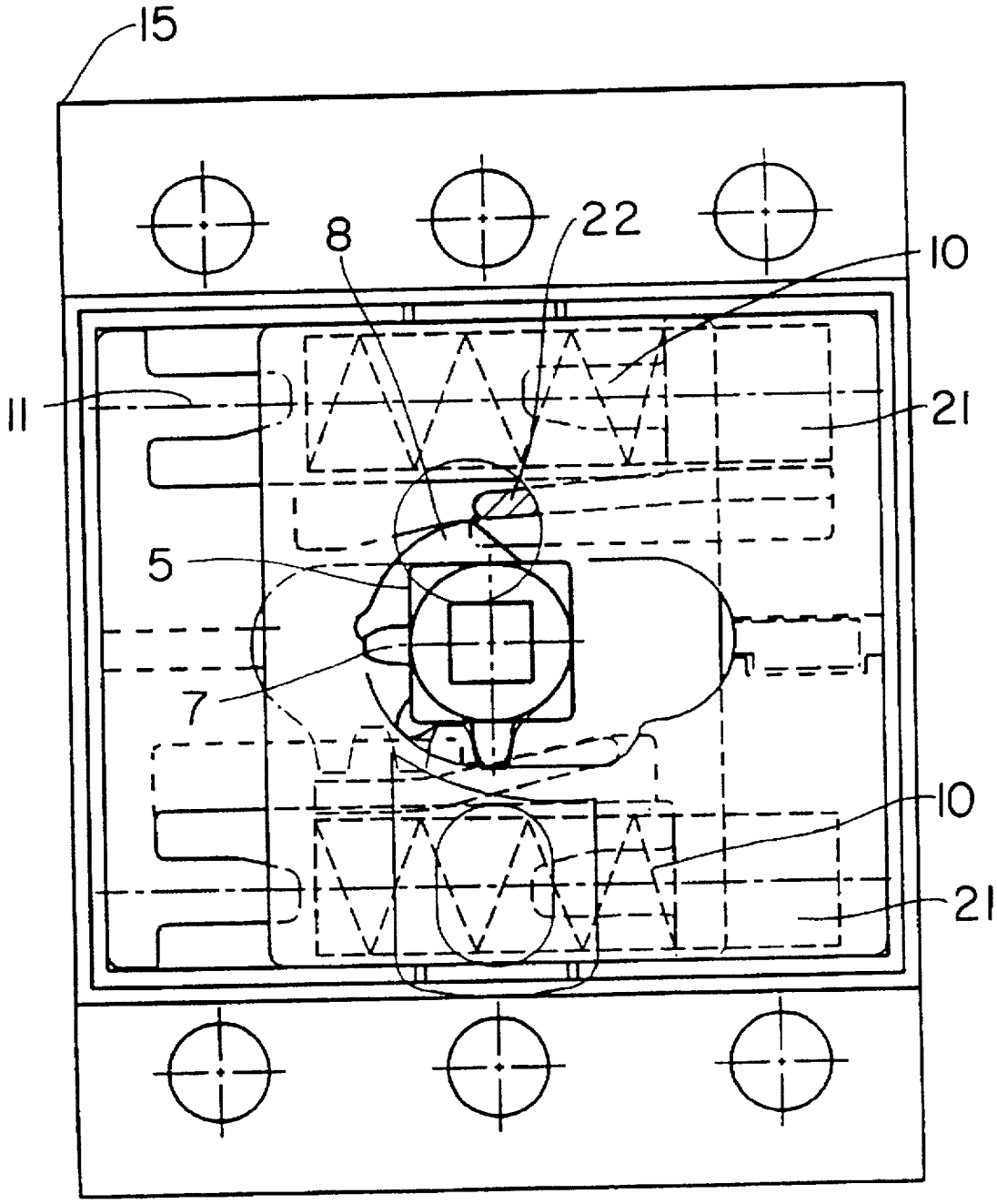
Figure 9:
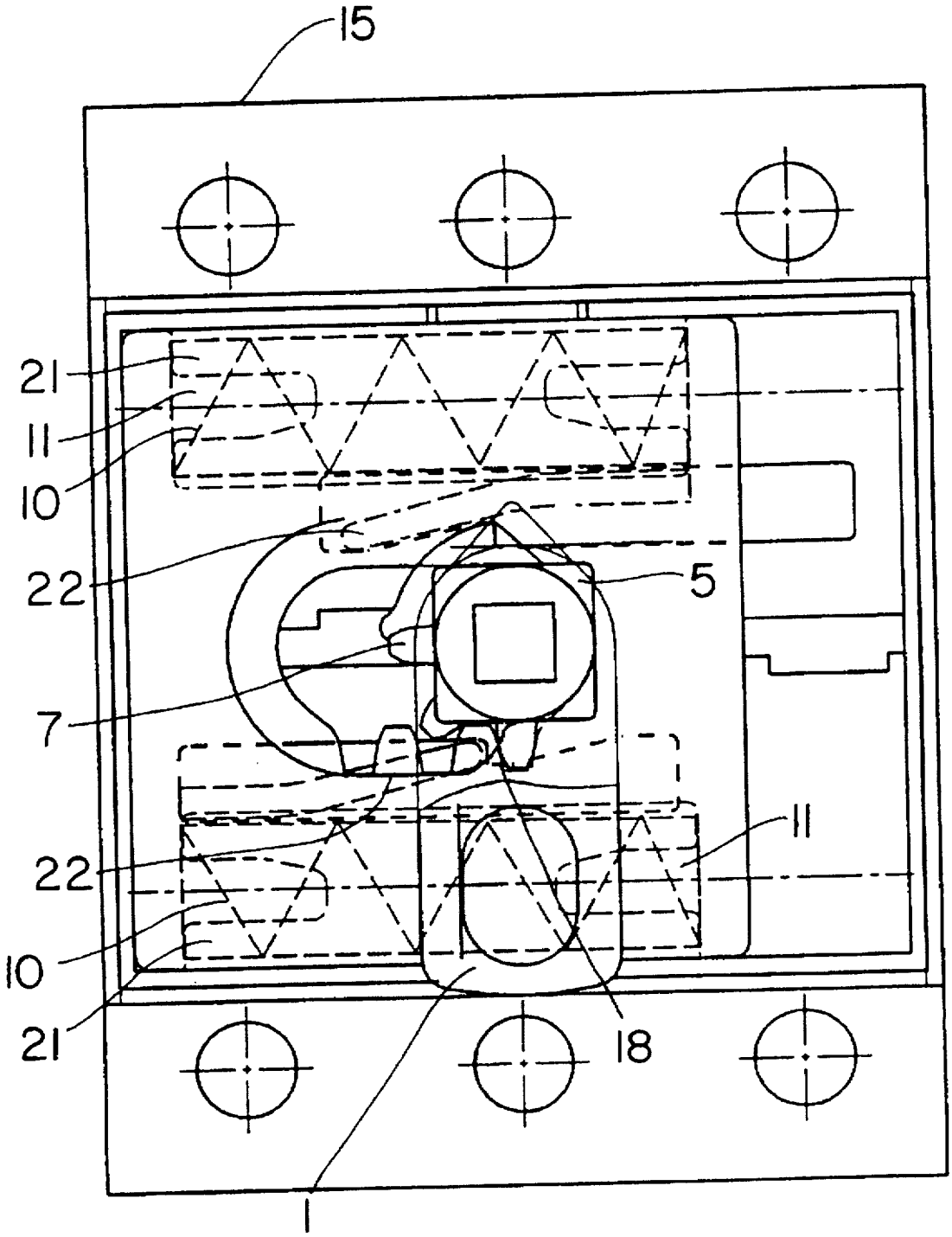
Figure 10:
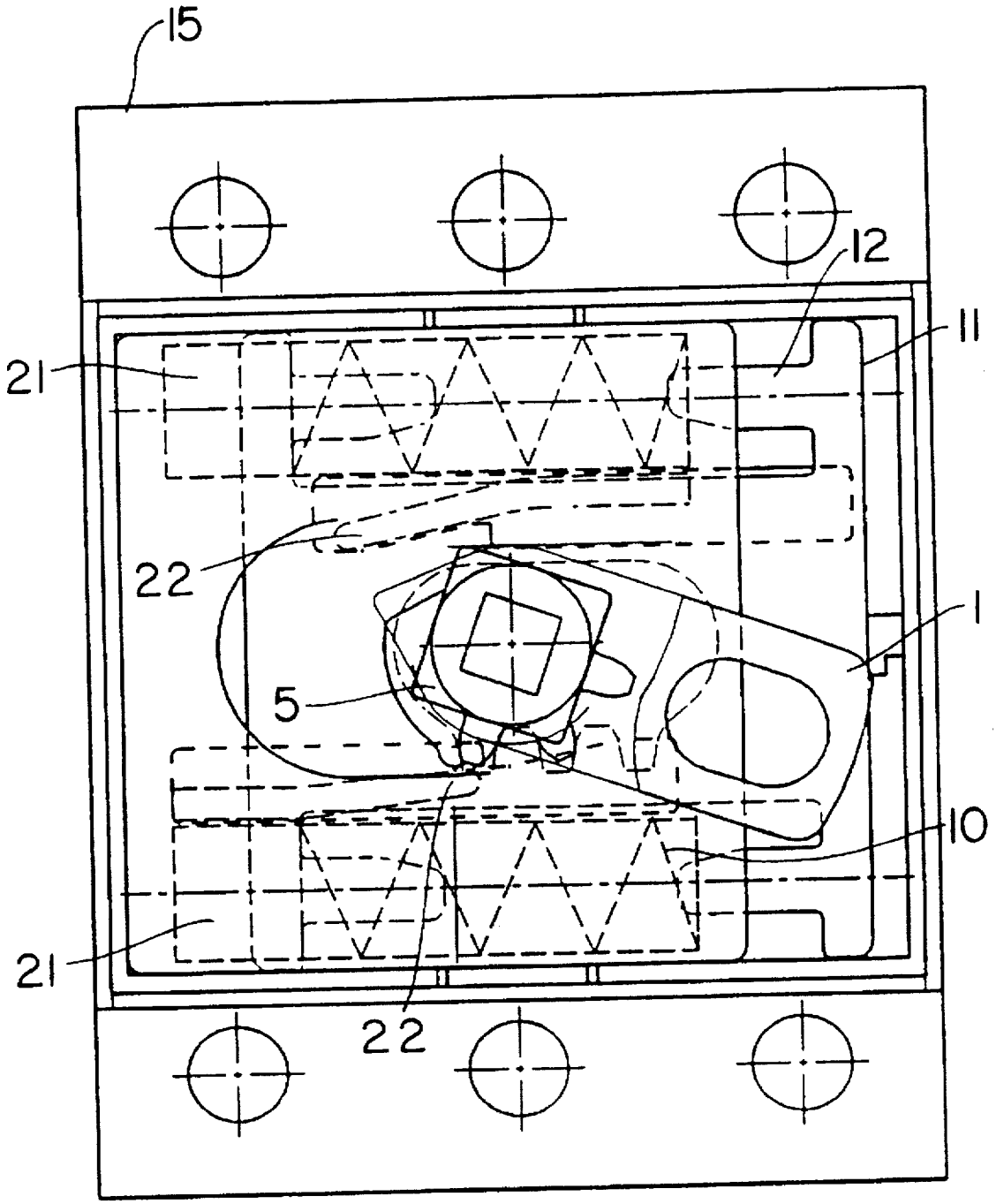

With reference to FIG. 7, the switch is shown in the OFF position, that is, the load current is switched off. The transfer teeth 7 of the switch operating shaft 4 have driven the power-spring-arming plate 11 to the right side of the assembly cavity and the power springs 10 push the lower and upper slide members 8, 14 to the same side. The first locking finger 22 of the lower slide member 14 is in this position of the switch pushed against the straight side of the locking tooth 18 of the locking slot 17 and this locks in place the lower slide member 14 as well as the upper slide member 8 connected thereto by means of the tab 20. When the switch operating shaft 4 is rotated clockwise, its transfer teeth 7 moves the power-spring-arming plate 11 to the left, whereby the power springs 10 are compressed because the locking finger 22 retains the slide members 8, 14 locked in place against the locking tooth 18 of the locking slot 17. After the switch operating lever 1 is rotated to point in approximately the downward direction, that is, to the ON position of the switch, the cam of the switch operating shaft 4 meets the locking finger 22 and lifts it off of the notch of the locking tooth 18 (FIG. 8). The slide members 8, 14 can now move to the left, and are in fact pushed to the left side of the assembly cavity under the pushing force exerted by the power springs 10. With the movement of the lower slide member 14, the electric connection is established at the toggling of the switch to its ON position. During the movement of the lower slide member 14 to the left side of the cavity, the locking finger opposite to the first locking finger drops into the notch of the locking tooth 18 of the locking slot 17, thus locking the lower and upper slide members 14, 8 in place. The final position of the switch is as shown in FIG. 9.

Toggling the switch from the ON position to the OFF position occurs in a normal situation in a corresponding manner to that described above for toggling to the 0N position. The only difference is that the power-spring-arming plate 11 and the slide members 8, 14 now move to the right. However, sometimes the contact surfaces of the switch may become welded together due to, e.g., poor contact. Then, the force exerted by the power springs 10 is not sufficient for separating the contacts, whereby the slide members 8, 14 remain to the left side of the cavity, and the switch cannot open. For such a case, the upper slide member 8 is provided with a force-exerting surface 9, which cooperates with the endmost tooth 23 on the switch operating shaft 4. The endmost transfer tooth 23 extends slightly higher in the longitudinal axis direction of the switch operating shaft 4 than the rest of the transfer teeth 7, whereby the endmost tooth extends into the aperture 30 of the upper slide member 8.

In a welding situation of the contacts, the switch is opened in the following manner. After the switch operating lever I has been rotated counterclockwise and the cam 6 of the switch operating shaft has released the locking finger 22, the lower slide member 14 mad the upper slide member 8 connected to the lower slide member still remain to the left due to contact welding. As the switch operating lever 1 is rotated further, the endmost transfer tooth 23 on the switch operating shaft 4 meets the force-exerting surface 9 of the upper slide member 8, thereby pushing both slide members 8, 14 to the right, whereby the weld between the contacts is generally detached. After the weld detachment, the power springs 10 push the slide members 8, 14 in a normal manner to the right thus setting the switch to the OFF position. If the weld between the contacts is so strong as to persistently resist such a forced separation attempt, the power springs 10 push the power-spring-arming plate 11 and the switch operating lever 1 back to the 0N position as soon as the operator releases his grip from the lever, whereby no ambiguity can remain as to actual state of the switch.

The switch operating shaft 4 further has a square section comprising four lobes divided at equal angles. The detent leaf springs 3 are placed close to the side of the switch operating shaft 4 at said cams 5 so that the cams 5 rest against the leaf springs 3 when the shaft is rotated. Thus, said leaf springs 3 act as a detent for the rotational movement of the switch operating shaft 4 so that the switch operating shaft 4 is clearly positioned at 90° increments. The force exerted by these detent leaf springs 3 must be dimensioned so that the power springs 10 can return the switch operating lever 1 and shaft 4 back to the OFF position in persisting cases of switch contact welding.

In addition to the preferred embodiment of the invention described above, the present invention can be implemented in a plurality of alternative manners. For instance, the switch springs can be any desired type of spring elements or similar resilient energy-storing elements. The locking of the slide members can be simply realized using other types of locking means different from the locking fingers described above. A plurality of such locking finger/backing surface combinations are known in the art. Further, the upper slide member can be omitted from the construction and its functions combined with those of the lower slide member. Correspondingly, the mutual placement of the slide members and power-spring-arming plate can be interchanged and the electrical contacts can be adapted to the sides of the switch housing, as well as below it. The contact bridge may be a separate element, or alternatively, the moving contacts can be incorporated in the lower slide member.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A switch device for the control of electrical equipment, said device comprising:

a housing provided with stationary contacts for forming an electric contact, a body piece attached to said housing, a switch operating shaft operatively communicating with said body piece so as to be rotatable about its longitudinal axis, and moving contacts adapted to make a physical contact with the stationary contacts for forming an electric contact, wherein at least one slide member operatively communicates with said body piece said slide member being linearly movable relative to said body piece so that the moving contacts make electric contact with the stationary contacts by virtue of the movement of said slide member, at least one power-spring-arming plate operatively communicating with said body piece is transferrable by the rotation of the switch operating shaft in a parallel direction with said slide member, and at least one spring-type member connecting the power-spring-arming plate to said slide member transmits the movement of said power-spring-arming plate.

2. The switch as defined in claim 1, wherein:

at least one, first locking member locks said slide member to a first position relative to the body piece and is releasable from its locked position by the rotation of the switch operating shaft, and at least one, second locking member locks said slide member to a second position relative to the body piece and is releasable from its locked position by the rotation of the switch operating shaft.

3. The switch as defined in claim 2, wherein:

said at least one slide member comprises a first slide member which operatively communicates with one side of said power-spring-arming plate and contains locking members, and a second slide member which operatively communicates with the other side of said power-spring-arming plate and is permanently connected to said first slide member.

4. The switch as defined in claim 3, wherein an aperture is provided in said first slide member, said second slide member and said power-spring-arming plate for receiving the switch operating shaft.

5. The switch as defined in claim 4, wherein a projection detail is provided on the switch operating shaft and a force-exerting surface detail is provided at the side of the aperture in the second slide member, both details cooperating so that the second slide member is force-controlled, movable by the rotation of the switch operating shaft, whereby the projection detail of the shaft meets said force-exerting surface detail.

* * * * *